US010577222B2

(12) United States Patent
Sudi et al.

(10) Patent No.: US 10,577,222 B2
(45) Date of Patent: Mar. 3, 2020

(54) CODED ELEVATOR INSPECTION AND POSITIONING SYSTEMS AND METHODS

(71) Applicant: Otis Elevator Company, Farmington, CT (US)

(72) Inventors: Sandeep Sudi, Unionville, CT (US); Daniel M. Tripp, Sr., Deerfield, NH (US); Sally Day Mahoney, New Hartford, CT (US); Frank Higgins, Burlington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 397 days.

(21) Appl. No.: 15/593,441

(22) Filed: May 12, 2017

(65) Prior Publication Data

US 2018/0327221 A1 Nov. 15, 2018

(51) Int. Cl.

| | |
|---|---|
| ***B66B 1/34*** | (2006.01) |
| ***B66B 5/00*** | (2006.01) |
| ***B66B 3/00*** | (2006.01) |
| ***B66B 5/02*** | (2006.01) |
| ***B66B 9/00*** | (2006.01) |
| ***B66B 13/00*** | (2006.01) |

(52) U.S. Cl.

CPC ..... *B66B 5/0031* (2013.01); *B66B 1/3492* (2013.01); *B66B 3/00* (2013.01); *B66B 5/0025* (2013.01); *B66B 5/0037* (2013.01); *B66B 5/0087* (2013.01); *B66B 5/02* (2013.01); *B66B 9/00* (2013.01); *B66B 13/00* (2013.01)

(58) Field of Classification Search

CPC ..... B66B 5/0031; B66B 1/3492; B66B 3/00; B66B 5/0025; B66B 5/0037; B66B 5/0087; B66B 5/02; B66B 9/00; B66B 13/00

USPC ..... 187/247, 277, 284, 291, 316, 317, 391, 187/393, 394

See application file for complete search history.

(56) References Cited

U.S. PATENT DOCUMENTS 4,256,203 A * 3/1981 Masel ..... B66B 1/44 187/291
4,568,909 A * 2/1986 Whynacht ..... B66B 5/0006 187/393

(Continued)

FOREIGN PATENT DOCUMENTS

CN 1187456 A 7/1998
CN 201473135 5/2010

(Continued)

OTHER PUBLICATIONS

European Search Report, European Application No. 18171924.6, dated Sep. 24, 2018, European Patent Office; European Search Report 8 pages.

*Primary Examiner* — Anthony J Salata
(74) *Attorney, Agent, or Firm* — Cantor Colburn LLP

(57) ABSTRACT

Elevator systems having an elevator car within an elevator shaft are described. The systems include a plurality of landing doors located at respective landings within the elevator shaft with at least one landing positioning element installed within the elevator shaft and positioned relative to at least one landing door. An inspection system is configured with a detector located on the elevator car and arranged to detect the presence of the landing positioning element in an inspection region to determine if a position of the elevator car relative to the landing door is within a predetermined range.

14 Claims, 6 Drawing Sheets

(56) References Cited

U.S. PATENT DOCUMENTS

| | | | | |
|---|---|---|---|---|
| 4,785,914 | A * | 11/1988 | Blain | B66B 1/24 187/280 |
| 4,898,263 | A * | 2/1990 | Manske | B66B 5/0087 187/247 |
| 5,135,081 | A | 8/1992 | Watt et al. | |
| 6,435,315 | B1 | 8/2002 | Zaharia | |
| 6,612,403 | B2 * | 9/2003 | Silberhorn | B66B 1/3492 187/394 |
| 6,868,945 | B2 * | 3/2005 | Schuster | B66B 1/468 187/380 |
| 7,597,176 | B2 * | 10/2009 | Zaharia | B66B 1/3492 187/394 |
| 7,650,970 | B2 | 1/2010 | Lelic et al. | |
| 7,699,142 | B1 * | 4/2010 | Wurth | B66B 5/0025 187/247 |
| 7,950,499 | B2 * | 5/2011 | Okamoto | B66B 1/3492 187/293 |
| 8,857,572 | B2 | 10/2014 | Leutenegger et al. | |
| 8,960,376 | B2 | 2/2015 | Coi | |
| 9,296,591 | B2 * | 3/2016 | Garfinkel | B66B 1/3492 |
| 9,352,934 | B1 | 5/2016 | Lee | |
| 9,359,170 | B2 * | 6/2016 | Schatt | B66B 1/3492 |
| 9,399,562 | B2 | 7/2016 | Terry et al. | |
| 9,469,501 | B2 | 10/2016 | Lee | |
| 9,567,188 | B2 * | 2/2017 | Huff | B66B 5/0025 |
| 9,809,419 | B2 * | 11/2017 | Otsuka | B66B 1/3492 |
| 2006/0232789 | A1 | 10/2006 | Oh et al. | |
| 2008/0156591 | A1 | 7/2008 | Tracey | |

FOREIGN PATENT DOCUMENTS

| | | | |
|---|---|---|---|
| CN | 103058039 | | 4/2013 |
| CN | 103097272 | A | 5/2013 |
| CN | 103322930 | | 9/2013 |
| CN | 105173949 | | 12/2015 |
| EP | 2990369 | A1 | 3/2016 |
| JP | H07206341 | | 8/1995 |
| JP | 2007145475 | A | 6/2007 |
| JP | 5278146 | | 9/2013 |
| JP | 2014076871 | | 5/2014 |
| JP | 2015044672 | A | 3/2015 |
| JP | 5814734 | B2 | 11/2015 |
| TW | 212836 | B | 9/1993 |
| WO | 2015118064 | | 8/2015 |

* cited by examiner

CODED ELEVATOR INSPECTION AND POSITIONING SYSTEMS AND METHODS

BACKGROUND

The subject matter disclosed herein generally relates to elevator systems and, more particularly, elevator inspection and positioning systems and methods.

An elevator system typically includes a plurality of belts or ropes (load bearing members) that move an elevator car vertically within a hoistway or elevator shaft between a plurality of elevator landings. Positioning elevator cars relative to landings to enable ease of loading/unloading of passengers is an important feature of elevator systems.

For example, when the elevator car is stopped at a respective one of the elevator landings, changes in magnitude of a load within the car can cause changes in vertical position of the car relative to the landing. The elevator car can move vertically down relative to the elevator landing, for example, when one or more passengers and/or cargo move from the landing into the elevator car. In another example, the elevator car can move vertically up relative to the elevator landing when one or more passengers and/or cargo move from the elevator car onto the landing. Such changes in the vertical position of the elevator car can be caused by soft hitch springs and/or stretching and/or contracting of the load bearing members, particularly where the elevator system has a relatively large travel height and/or a relatively small number of load bearing members. Under certain conditions, the stretching and/or contracting of the load bearing members and/or hitch springs can create disruptive oscillations in the vertical position of the elevator car, e.g., an up and down "bounce" motion. Accordingly, it is advantageous to ensure that elevator cars are appropriately positioned to landing doors.

SUMMARY

According to some embodiments, elevator systems are provided. The elevator systems include an elevator car within an elevator shaft, a plurality of landing doors located at respective landings within the elevator shaft, at least one landing positioning element installed within the elevator shaft and positioned relative to at least one landing door, and an inspection system comprising a detector located on the elevator car and arranged to detect the presence of the landing positioning element in an inspection region to determine if a position of the elevator car relative to the landing door is within a predetermined range.

In addition to one or more of the features described herein, or as an alternative, further embodiments of the elevator systems may include a control unit configured to analyze an output of the detector, determine if there is an error in the elevator car position relative to the landing, and generate an error notification when an error in the elevator position is determined.

In addition to one or more of the features described herein, or as an alternative, further embodiments of the elevator systems may include that the control unit is located on the elevator car and in communication with the detector.

In addition to one or more of the features described herein, or as an alternative, further embodiments of the elevator systems may include that the detector captures images of the landing positioning element for inspection.

In addition to one or more of the features described herein, or as an alternative, further embodiments of the elevator systems may include that the landing positioning element includes at least one of a colored paint, a textured surface, or a reflective surface.

In addition to one or more of the features described herein, or as an alternative, further embodiments of the elevator systems may include that the detector is located on one of a top or bottom of the elevator car.

In addition to one or more of the features described herein, or as an alternative, further embodiments of the elevator systems may include that the detector comprises at least two cameras arranged to inspect multiple landing positioning element located at a specific landing.

In addition to one or more of the features described herein, or as an alternative, further embodiments of the elevator systems may include that the landing positioning element comprises at least one position detection subelement.

In addition to one or more of the features described herein, or as an alternative, further embodiments of the elevator systems may include that the at least one position detection subelement comprises a first region defining a range of position of proper alignment of the elevator car relative to the landing door and a second region that is outside of the first region.

In addition to one or more of the features described herein, or as an alternative, further embodiments of the elevator systems may include that, when the second region is detected within the inspection region, an error notification is generated.

According to some embodiments, methods for inspecting landing positions of an elevator car within elevator systems are provided. The methods include moving an elevator car to a landing within an elevator shaft, observing an inspection region using a detector located on the elevator car, the inspection region being a region including a landing positioning element positioned relative to a landing door of the landing, determining if an error exists with the position of the elevator car relative to the landing based on the landing positioning element within the inspection region, and generating an error notification when an error in the elevator position is determined.

In addition to one or more of the features described herein, or as an alternative, further embodiments of the methods may include that the method is performed automatically based on at least one of (i) a maintenance schedule, (ii) a predetermined interval, (iii) every time the elevator stops at a landing, (iv) a customer complaint, (v) a request made at an onsite location, (vi) a request made at an offsite location, or (vii) a scheduled maintenance visit.

In addition to one or more of the features described herein, or as an alternative, further embodiments of the methods may include analyzing an output of the detector with a control unit, determining if there is an error in the elevator car position relative to the landing, and generating an error notification when an error in the elevator position is determined.

In addition to one or more of the features described herein, or as an alternative, further embodiments of the methods may include that the control unit is located on the elevator car and in communication with the detector.

In addition to one or more of the features described herein, or as an alternative, further embodiments of the methods may include capturing images of the landing positioning element for inspection.

In addition to one or more of the features described herein, or as an alternative, further embodiments of the methods may include that the landing positioning element includes at least one of a colored paint, a textured surface, or a reflective surface.

In addition to one or more of the features described herein, or as an alternative, further embodiments of the methods may include that the detector comprises at least two cameras arranged to inspect multiple landing positioning element located at a specific landing.

In addition to one or more of the features described herein, or as an alternative, further embodiments of the methods may include that the landing positioning element comprises at least one position detection subelement.

In addition to one or more of the features described herein, or as an alternative, further embodiments of the methods may include that the at least one position detection subelement comprises a first region defining a range of position of proper alignment of the elevator car relative to the landing door and a second region that is outside of the first region.

In addition to one or more of the features described herein, or as an alternative, further embodiments of the methods may include that, when the second region is detected within the inspection region, the method further comprises generating an error notification.

In addition to one or more of the features described herein, or as an alternative, further embodiments of the methods may include moving the elevator car to a second landing within the elevator shaft, observing an inspection region of the second landing using the detector, the inspection region being a region including a landing positioning element at the second landing, determining if an error exists with a position of the elevator car relative to the second landing based on the landing positioning element detected within the inspection region at the second landing, and generating an error notification when an error in the elevator position is determined.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
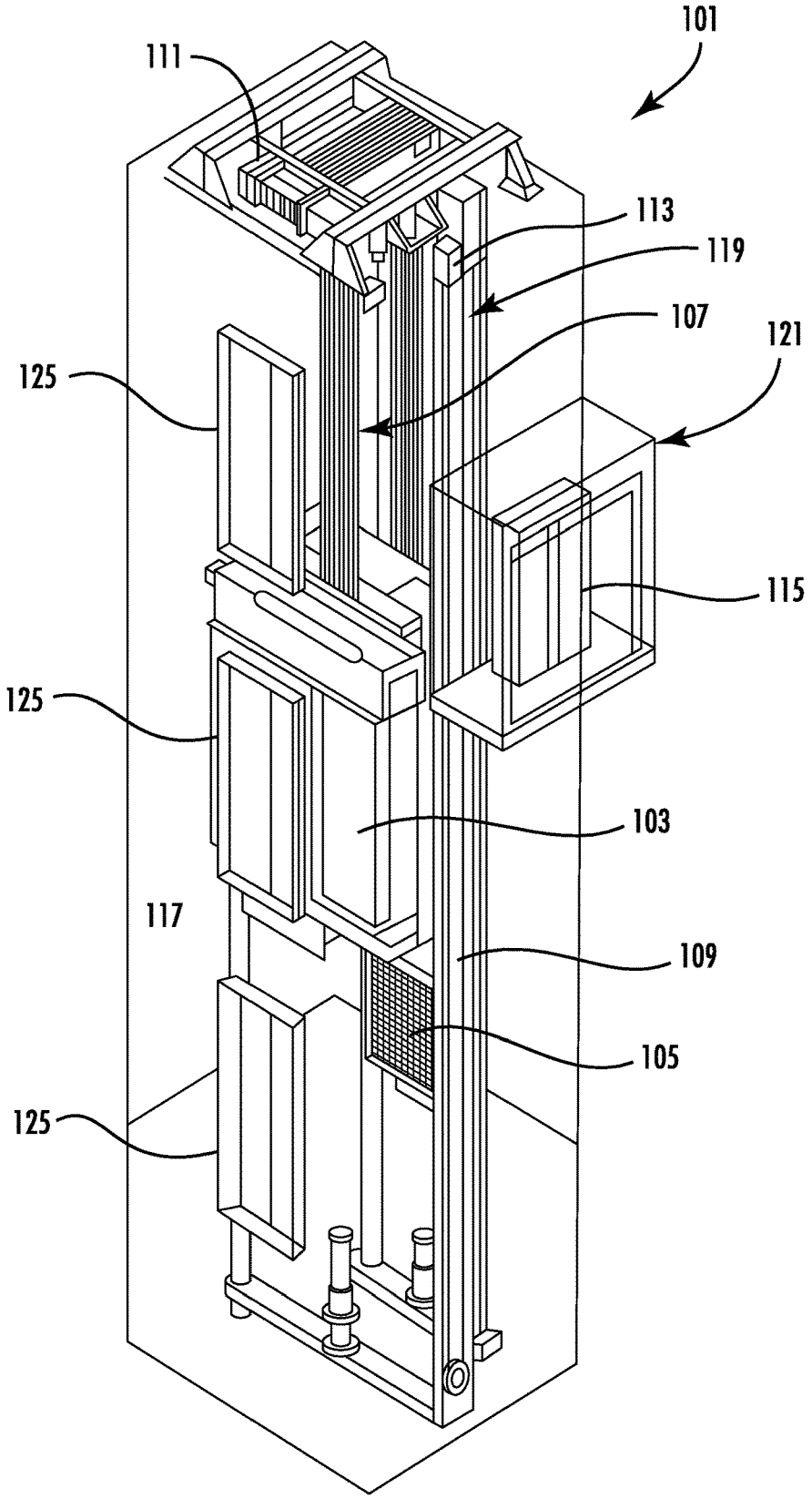
FIG. 1 PRIOR ART
FIG. 1 is a schematic illustration of an elevator system that may employ various embodiments of the present disclosure.

As shown and described herein, various features of the disclosure will be presented. Various embodiments may have the same or similar features and thus the same or similar features may be labeled with the same reference numeral, but preceded by a different first number indicating the figure to which the feature is shown. Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Elevators are subject to inspection and monitoring to comply with code requirements. Additionally, elevators must be positioned at landings accurately to ensure smooth operation and ease of loading/unloading of passengers. Inspection, monitoring, associated repairs, etc. can be expensive, time consuming, and/or inconvenient. Further, improper alignment and/or inaccurate positioning at a landing can retract from passenger experiences. Accordingly, it may be advantageous to develop systems, devices, and processes to improve the efficiency of inspection, monitoring, and positioning accuracy of elevator cars at landings within an elevator system. For example, in accordance with embodiments of the present disclosure, systems and processes are provided to improve landing position accuracy and/or inspections of landing position accuracy.

Figure 2A:
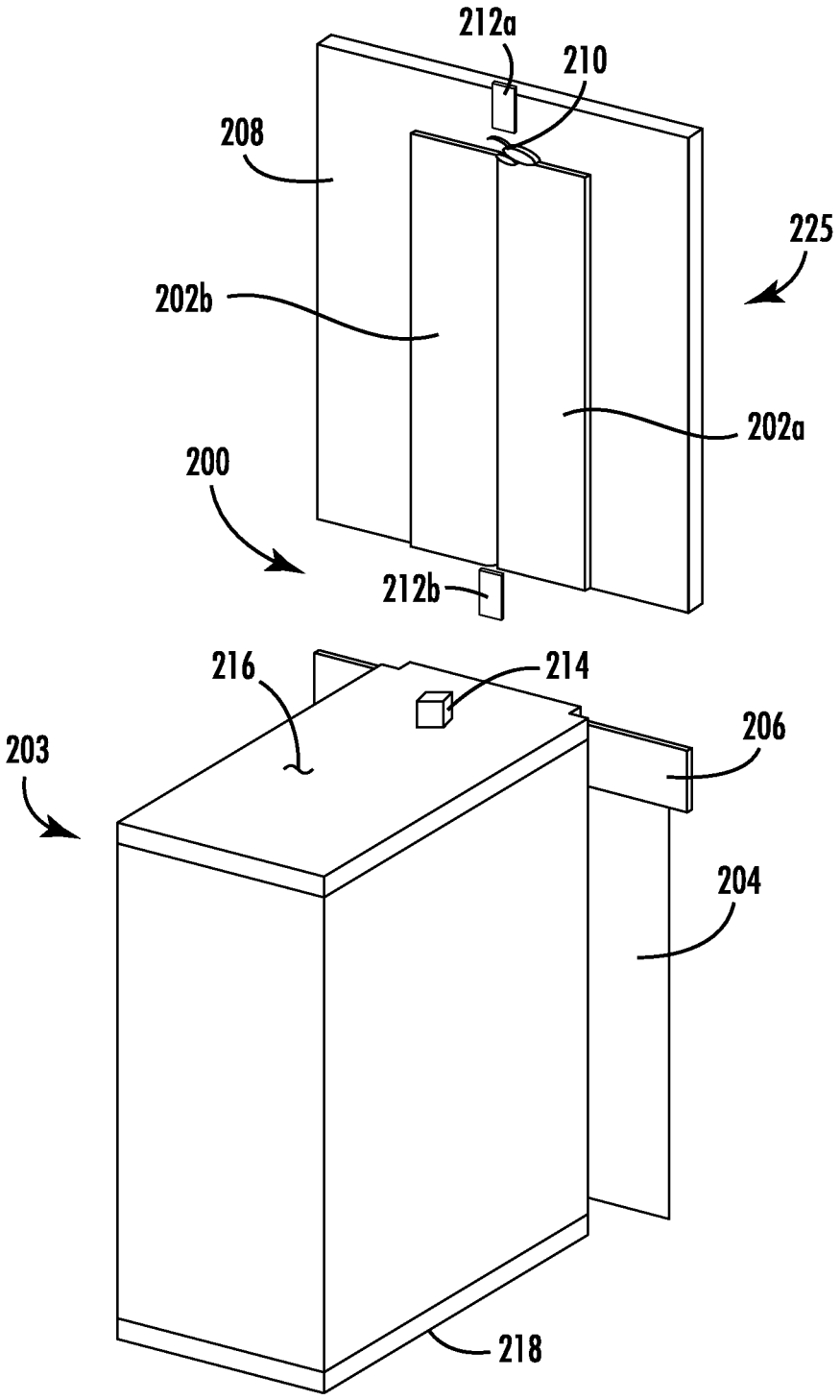
FIG. 2A is a schematic illustration of an elevator car having a landing position inspection system in accordance with an embodiment of the present disclosure.
Figure 2B:
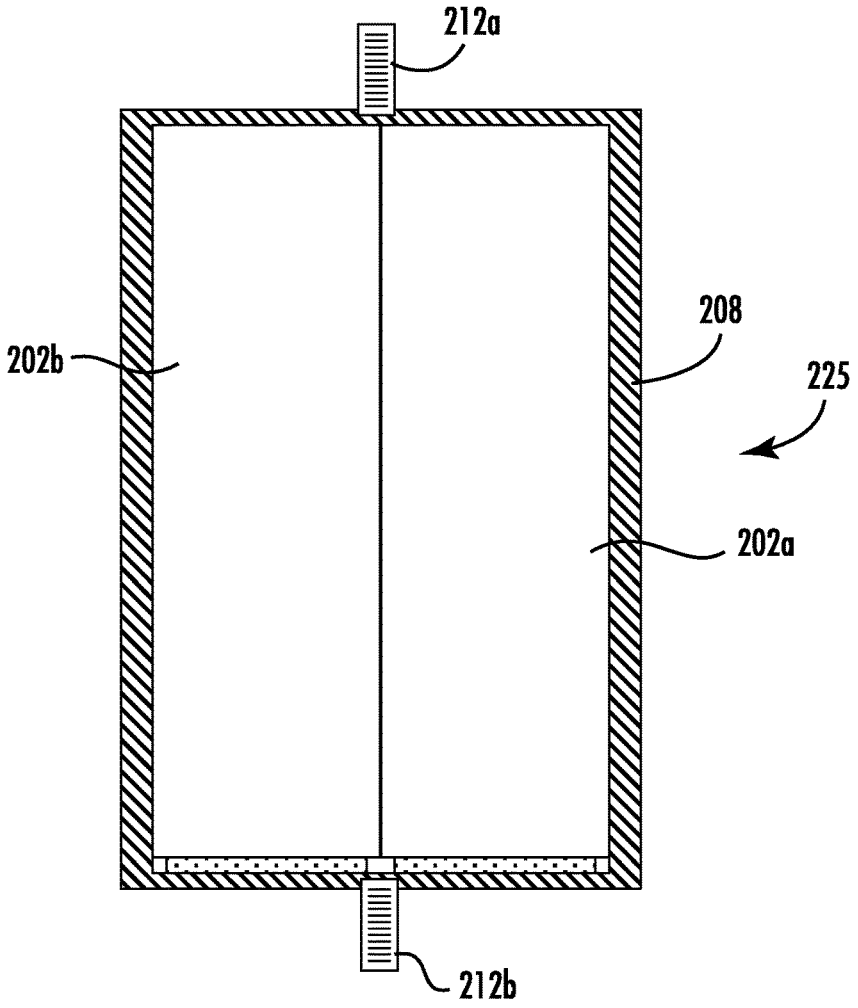
FIG. 2B is plan elevation illustration of the landing door of the elevator system of FIG. 2A.
Figure 2C:
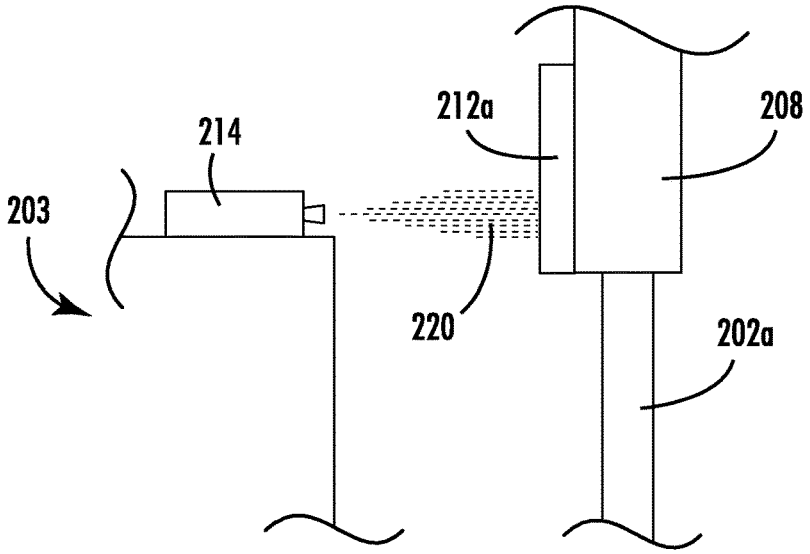
FIG. 2C is an enlarged illustration of the landing position inspection system of FIGS. 2A-2B.

Turning now to FIGS. 2A-2C, schematic illustrations of a landing position inspection system 200 in accordance with an embodiment of the present disclosure are shown. FIG. 2A schematically illustrates an elevator car 203 and a landing 225 having landing doors 202*a*, 202*b*. The elevator car 203 has elevator car doors 204 and a car lintel 206. When the elevator car 203 is located at the landing doors 202*a*, 202*b*, the car lintel 206 aligns with a portion of a landing door frame 208 that includes a landing door lock 210. The landing door frame 208 includes a landing door sill having a track and enables the landing doors 202*a*, 202*b* to open and close within the landing door frame 208, as will be appreciated by those of skill in the art. In operation, a mechanism within the car lintel 206 engages with and unlocks the landing door lock 210 to operate the landing doors 202*a*, 202*b* to open when the landing doors 202*a*, 202*b* open. To ensure proper engagement between the elevator car 203 (and components thereof) and the landing 225 (and components thereof), the elevator car 203 must be properly and accurately positioned within an elevator shaft and relative to the landing 225.

To monitor the position of the elevator car 203 relative to the landing, the landing position inspection system 200 includes a detector 214 positioned on the elevator car 203. The detector 214 and/or other detectors can be positioned at one or more locations on the exterior of the elevator car 203 and/or mounted within the elevator car 203. If mounted on the exterior, the detector may have direct line of sight to one or more features within the elevator car. However, in embodiments with the detector installed on an interior portion of the elevator car, a window, opening, or other mechanism can be provided to enable the detector to be able to view features within the elevator shaft (e.g., external from the elevator car).

In the embodiment schematically shown in FIG. 2A, the detector 214 is mounted on a top 216 of the elevator car 203. In some embodiments the detector (or an additional detector) can be positioned on a bottom 218 of the elevator car 203, or located on some other exterior surface and/or the interior of the elevator car 203 and arranged to view portions or areas of the landing 225, as described herein. The detector 214 is arranged to detect a position of the elevator car 203 relative to the landing 225 within the elevator shaft to ensure proper positioning of the elevator car 203. The detector 214 can be a camera or other visual/optical detector that can detect and measure a feature within the elevator shaft, and, particularly, a feature relative to the landing 225 (e.g., located on the landing door frame 208 or elsewhere within the elevator shaft). In some embodiments, as the elevator car 203 approaches the landing 225, the detector 214 can capture one or more images or video of one or more landing positioning elements 212*a*, 212*b* and thus measure and detect a position of the elevator car 203 relative to the landing 225, as described herein.

Although shown with landing positioning elements 212*a*, 212*b* located proximate the landing doors 202*a*, 202*b* (e.g., above and below the doors), those of skill in the art will appreciate that other locations and/or additional landing positioning elements can be installed within the elevator shaft at other locations. For example, in some embodiments, one or more landing positioning elements can be positioned on a wall of the elevator shaft opposite the landing doors and/or on walls of the elevator shaft that are normal to (or next to) the landing doors. Further, in some embodiments, rather than being positioned above and below the landing doors, one or more landing positioning elements can be arranged to the sides of the landing doors. That is, the location of the landing positioning elements is not to be limiting, and in each configuration one or more detectors are appropriately arranged on an exterior or interior of the elevator car.

FIG. 2B is a front elevation illustration of the landing 225 of FIG. 2A and FIG. 2C is a side view illustration of a portion of the landing 225. As shown in FIGS. 2B-2C, the landing doors 202*a*, 202*b* are positioned within the landing door frame 208 and a first landing positioning element 212*a* and a second landing positioning element 212*b* are arranged relative to the landing 225 on the landing door frame 208.

As the elevator car 203 approaches the landing 225, the detector(s) 214 can capture images and/or video of the landing positioning elements 212*a*, 212*b*. The images/video can be analyzed to determine if the elevator car 203 is properly and accurately positioned. The landing positioning elements 212*a*, 212*b* can be arranged to enable ease of detection by the detector(s) 214, and can include a coloring, paint, texturing, surface feature(s), etc. that are readily detectable by the detector(s) 214. Because of the landing positioning elements 212*a*, 212*b* in accordance with the present disclosure, the detector(s) 214 can determine if the elevator car 203 is properly positioned relative to the landing 225. Based on the detection, the landing position inspection system 200 can generate an error notification if the landing position of the elevator car is not as expected. In some embodiments, the landing positioning elements 212*a*, 212*b* can include a scale or other indicator to enable precise positioning of the elevator car 203 within the elevator shaft.

The detector 214, as shown in FIG. 2C, can make observations and/or inspections of the landing positioning element 212*a* at an inspection region 220. The inspection region 220 is a preset location or region when the detector 214 actively observes the elevator shaft, and particularly, observes the landing positioning element 212*a*.

FIGS. 2A-2C illustrate a single detector 214 arranged to observe the landing positioning elements 212*a*, 212*b* (e.g., above and below the landing doors 202*a*, 202*b*). However, in alternative embodiments, two or more detectors can be installed or otherwise arranged at various locations on the elevator car 203 to monitor and/or inspect the landing positioning elements 212*a*, 212*b*. For example, a first detector can be located on the top 216 of the elevator car 203 and a second detector can be located on the bottom 218 of the elevator car 203. In some embodiments, the detector(s) can be located on exterior side walls of the elevator car 203 and/or located within the elevator car 203 and provided with a mechanism for viewing the landing positioning elements 212*a*, 212*b* (e.g., window, opening, hole, aperture, mirrors, etc.).

Figure 3:
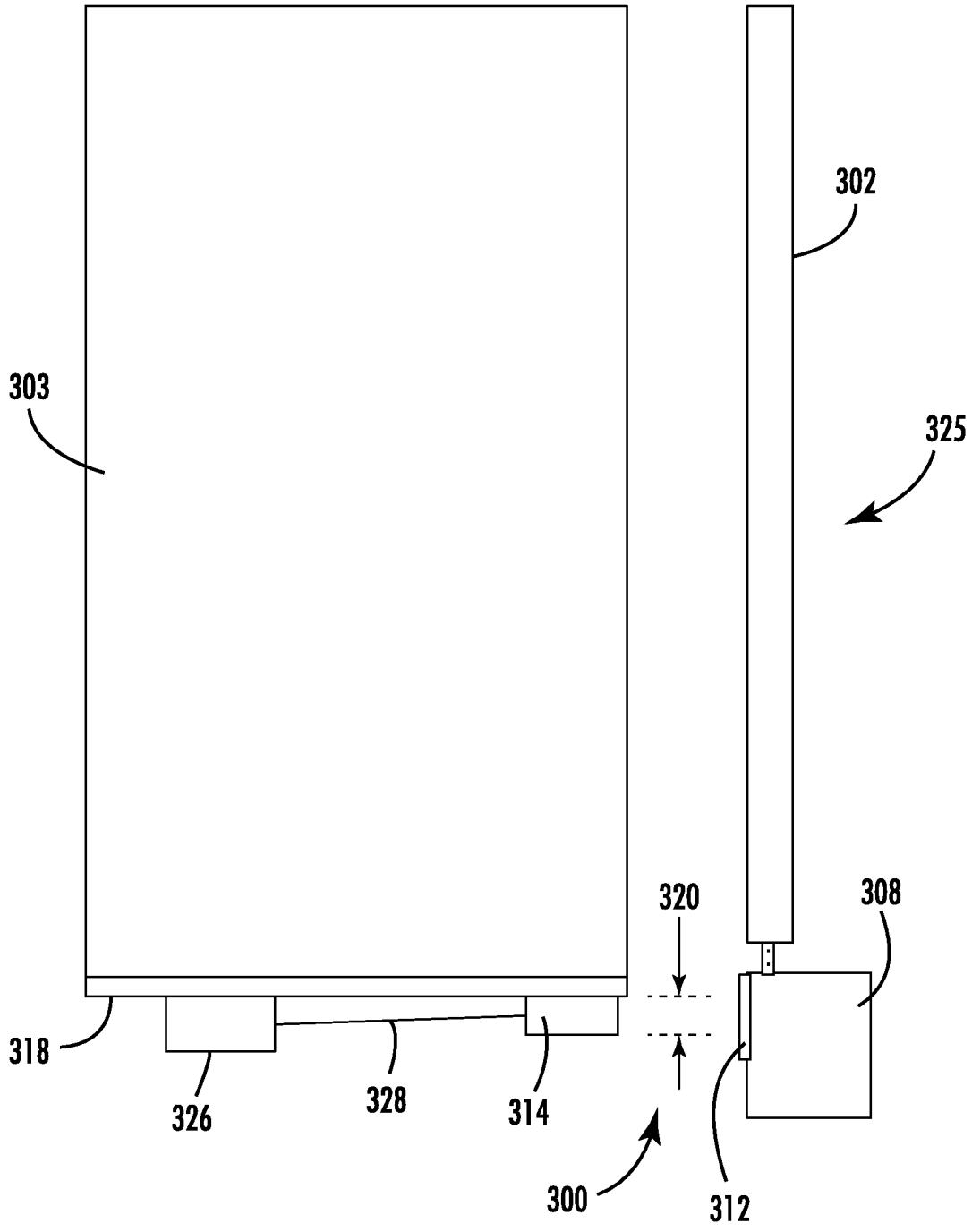
FIG. 3 is a side view illustration of a landing position inspection system in accordance with an embodiment of the present disclosure.

Turning now to FIG. 3, a schematic illustration of a landing position inspection system 300 in accordance with an embodiment of the present disclosure is shown. FIG. 3 schematically illustrates a detector 314 installed on an exterior surface of an elevator car 303, as shown the bottom 318 of the elevator car 303. The detector 314 is arranged to view a landing positioning element 312 that is fixedly positioned within an elevator shaft relative to and associated with a landing door 302 of a landing 325. As shown, the landing positioning element 312 is fixedly mounted or attached to a portion of a landing door frame 308 beneath the landing door 302.

The portion of the landing position inspection system 300 on elevator car 303 includes the detector 314, a control unit 326, and a communication connection 328 enabling communication between the detector 314 and the control unit 326. The control unit 326 can be a computer or other electronic device that can send commands to and receive data from the detector 314. In some embodiments, the control unit 326 can receive output from the detector 314 (e.g., images, video, etc.). The communication connection 328 can be a physical line or wire or can be a wireless communication connection, as will be appreciated by those of skill in the art. Further, although shown with the control unit 326 located on the bottom 318 of the elevator car 303, such arrangement is not to be limiting. For example, in some embodiments, the control unit can be part of an elevator controller or other electronics associated with other parts or components of the elevator system. In some embodiments, the control unit may be located remote from the elevator car. Further, in some embodiments, the control unit may be part of a general purpose computer that is configured to enable maintenance, inspection, and/or monitoring of the elevator system.

The detector 314 is arranged to view the position of the elevator car 303 relative to the landing door 302 by detecting and/or interacting with the landing positioning element 312 that is part of and/or applied to the landing door frame 308. The detector 314 is positioned and calibrated such that the detector 314 can detect the presence of the landing positioning element 312 within an inspection region 320. As shown, the inspection region 320 is defined as a space or zone aligned to and associated with the landing positioning element 312. The inspection region 320 is selected to be able to determine if the elevator car 303 is properly stopping at the landing 325. The inspection region 320 enables accurate measurement of the position of the elevator car 303 relative to the landing 325. The control unit 326 (or a portion of the detector 314 depending on electronic configuration) will perform image analysis of the inspection region 320 to determine what portion of the landing positioning element 312 is visible within the inspection region 320 to thus determine a positioning accuracy of the elevator car 303 relative to the landing 325.

The detector 314 (and/or the control unit 326) is configured to detect and determine the position of the elevator car 303 by viewing and/or interacting with the landing positioning element 312. The landing positioning element(s) of embodiments of the present disclosure can take various forms. For example, in some embodiments, the landing positioning elements can be a colored paint that has contrast with the color or texture of the landing door frame 308 and/or other feature within an elevator shaft (e.g., shaft wall). In such embodiments, the detector 314 can be an optical sensor (e.g., a camera) that is arranged to detect, at least, the presence of the colored paint of the landing positioning elements. In other embodiments, the landing positioning elements can be a reflective or refractive surface, texture, or coating that is applied to or part of the landing door frame 308 (or other fixed/static elevator shaft feature) and the detector 314 can be appropriately configured. For example, with a reflective surface landing positioning elements, the detector 314 can include a light source that projects light toward the reflective landing positioning elements. The detector 314 further includes, in such arrangements, a sensor that can detect if any light is reflected from the reflective landing positioning elements. In some embodiments, the landing positioning elements can be a textured surface or other surface feature of the landing door frame 308 that can be detected by the detector 314. Further still, in some embodiments, the landing positioning elements can be a coding that is applied and detectable by the detector 314 of the landing position inspection system 300. Moreover, in some embodiments, the detector 314 and/or the landing positioning elements 312 can be selected to operate at (and/or react to) a specific wavelength or range of wavelengths. Those of skill in the art will appreciate that various other types of detectors and/or indicator elements can be employed without departing from the scope of the present disclosure.

In operation, in one non-limiting example, such as an automated positioning and inspection operation, when the landing positioning elements 312 is detected by the detector 314 within the inspection region 320, the control unit 326 will determine whether the position of the elevator car 203 is properly in compliance with preset conditions and/or requirements (e.g., within a tolerance range of distance from level with the landing 325). If the detector 314 detects that the elevator car 303 is not properly indicated or positioned within the inspection region 320, the control unit 326 will determine that the positioning system of the elevator car 303 (e.g., machine 111, position encoder 113, and/or controller 115 shown in FIG. 2) is malfunctioning, is not in compliance with preset conditions or requirements, and/or is damaged. Such errors can result from defective or damages components, stretch of roping, etc. In such an instance, the control unit 326 can generate an error notification or other message that can be used to indicate that maintenance is required for the elevator system.

Figure 4:
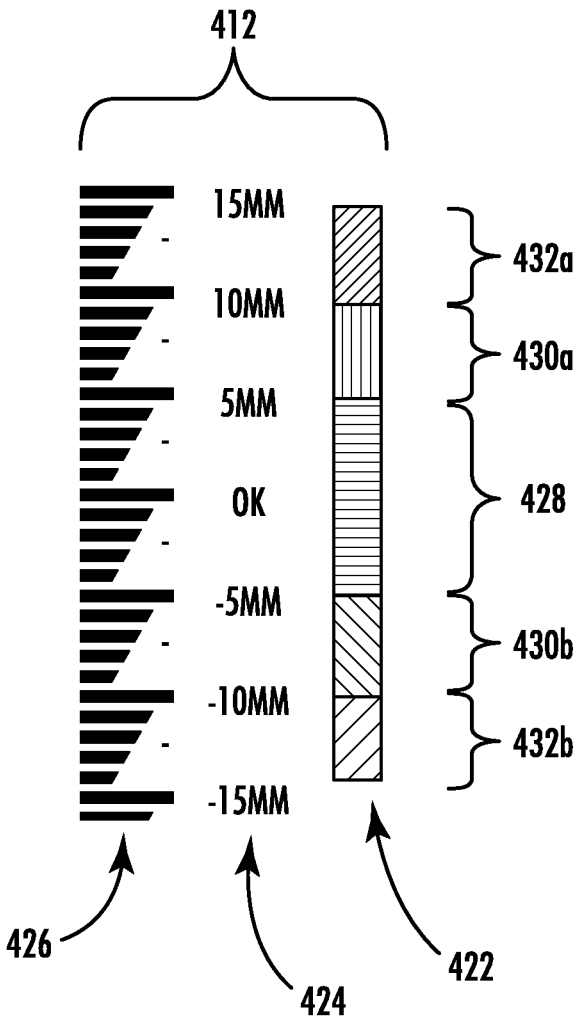
FIG. 4 is a schematic illustration of a landing positioning element in accordance with an embodiment of the present disclosure.

Turning now to FIG. 4, a schematic illustration of a landing positioning element 412 in accordance with an embodiment of the present disclosure is shown. As shown in the embodiment of FIG. 4, the landing positioning element 412 includes multiple different sub-elements to enable accurate position detection by a detector as shown and described herein.

The landing positioning element 412 includes a first position detection subelement 422, a second position detection subelement 424, and a third position detection subelement 426. As illustratively shown, the first position detection subelement 422 is a coded feature, which can be colored, with each color representing a different state of alignment of an elevator car when positioned at a landing. Further, in some embodiments, and as shown, the first position detection subelement 422 can include texture and/or markings to identify various regions or zones of the first position detection subelement 422.

For example, as shown, the first position detection subelement 422 has a first region 428 that is selected to represent proper alignment of the elevator car. The first region 428 can have a range that defines an acceptable tolerance of variation of the position of the elevator car with respect to a landing. A second region 430*a*, 430*b* of the first position detection subelement 422 defines one or more zones of concern that are outside of the first region 428. As shown, the second region 430*a*, 430*b* includes areas above and below the first region 428. The second region 430*a*, 430*b* can define areas outside of the first region 428 that are of concern but may not be outside of acceptable ranges of position. The second region 430*a*, 430*b* can be a color coded region and/or include markings to distinguish from the first region 428. The second region 430*a*, 430*b*, if detected by a detector, can indicate a first error of positioning of the elevator car, with the first error being defined by a first distance or offset from the first region 428.

Outside of the second region 430*a*, 430*b* is a third region 432*a*, 432*b* that represents a greater distance or offset from the first region 428. The third region 432*a*, 432*b* of the first position detection subelement 422 defines one or more zones of concern that are outside of the first region 428 and the second region 430*a*, 430*b*. As shown, the third region 432*a*, 432*b* includes areas above and below the second region 430*a*, 430*b*. The third region 432*a*, 432*b* can define areas outside of the second region 430*a*, 430*b* that are of concern and may be outside of acceptable ranges of position (e.g., a second error of positioning); or may be a range of ranges that are of concern but still within acceptable ranges of operation of the elevator system. The third region 432*a*, 432*b* can be a color coded region and/or include markings to distinguish from the first region 428 and the second region 430*a*, 430*b*. The third region 432*a*, 432*b*, if detected by a detector, can indicate a second error of positioning of the elevator car, with the second error being defined by a second distance or offset from the first region 428.

As schematically shown, and noted above, the landing positioning element 412 includes the second position detection subelement 424 and the third position detection subelement 426. The second position detection subelement 424, as shown, is textual and the third position detection subelement 426 is graphical. Thus, the landing positioning element 412 can include multiple different indicators to enable position detection by a detector as shown and described above. Although only three examples of different position detection subelements are shown and described, those of skill in the art will appreciate that other types of position detection subelements can be employed without departing from the scope of the present disclosure. Further, although the embodiment of FIG. 4 includes three position detection subelements, those of skill in the art will appreciate that landing positioning elements of the present disclosure can include more or fewer position detection subelements without departing from the scope of the present disclosure. The detectors of the present disclosure can be positioned such that a portion of the landing positioning elements described here can be detected and accurately measured.

Figure 5:
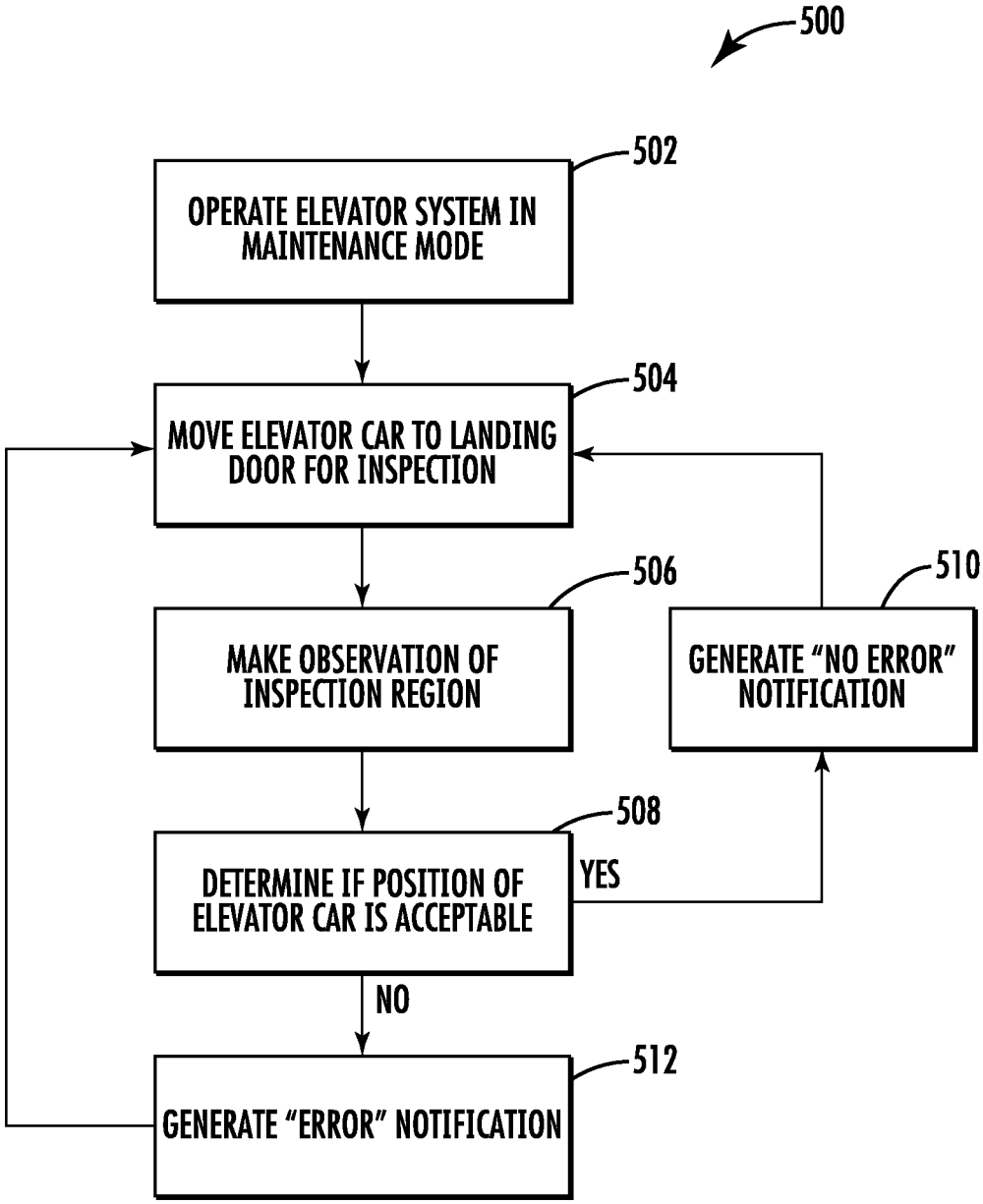
FIG. 5 is a flow process for performing landing position inspections in accordance with an embodiment of the present disclosure.

Turning now to FIG. 5, a flow process 500 for performing an automated elevator position inspection is shown. The elevator position inspection can be performed using an elevator system as shown and described above, having a control unit, detector, one or more landing positioning elements, and an elevator car moveable between landings within an elevator shaft. The elevator position inspection operation can be initiated by a mechanic or other person when it is desirable to determine the status of one or more landing positions of an elevator system (e.g., ensure an elevator car stops appropriately at one or more landings). Such inspection can be performed when an elevator system is first installed within a building, may be performed at various times after installation, such as to monitor the landing door gibs on a regular maintenance schedule, and/or may be performed during normal operation of the elevator system.

For example, the inspection could be automatically performed in an inspection run of the elevator through the elevator shaft on an hourly basis, daily basis, weekly basis, monthly basis, or at any other predetermined interval. In some embodiments, the inspection may be automatically performed every time the elevator stops at a landing. In some embodiments, the inspection may be automatically triggered by a customer complaint. In some embodiments, the inspection may be triggered remotely (e.g., by a remote computer system) or onsite by a mechanic. In one embodiment, the inspection may be triggered automatically in advance of a scheduled maintenance visit by a mechanic to the elevator installation and the results may be sent automatically to the mechanic in advance or saved in the elevator controller for the mechanic to download.

At block 502, the elevator system can be operated in a maintenance mode of operation. The operation within maintenance mode can be optional and in some embodiments, the flow process 500 (omitting block 502) can be performed during normal operation of the elevator system. In embodiments wherein the maintenance mode is activated, such activation can be manual or automatic. For example, in an example of manual operation, a mechanic or technician can use a control element to run the elevator system in maintenance mode to perform inspection or other maintenance operations while the mechanic or technician is present. In other embodiments, the maintenance mode of operation can be automatically activated, such as through an elevator controller or control unit that is programmed to perform automatic inspection and monitoring of various components of the elevator system.

At block 504, the elevator car is moved to a landing door for inspection (which can be during maintenance mode or based on a request by a passenger/potential passenger in normal operation mode). The landing door can be of any landing within an elevator shaft, and may be preselected based on a maintenance routine (e.g., automated and/or programmed), based on a selection or instruction from a mechanic or technician (e.g., manual selection), or based on a call made by a passenger/potential passenger. In some embodiments, such as when maintenance mode is activated, the movement of the elevator car can be controlled by a control unit to move within the elevator shaft at a maintenance speed of operation that may be slower than a normal operation speed. Such reduced speed can be beneficial for performing elevator position inspections in accordance with the present disclosure, although such reduced speeds are not required in all embodiments.

At block 506, a detector is used to observe an inspection region, such as shown and described above. The detector can be an optical detector or other sensor or device that can detect a landing positioning element located on or at a fixed (static) location within an elevator shaft and located proximate a landing/landing door, as shown and described above. The observation can be a picture or snapshot that is taken at a predetermined position to enable proper detection of the indicator element in the inspection region (if present). In some embodiments, the observation can be a video, continuous image capture/detection, and/or a series of image captures or detections.

At block 508, the detector and/or a control unit will analyze the observation made at block 506 to determine if the landing positioning element (or a portion thereof) is present in the inspection region. In some embodiments, the analysis may be digital and/or image analysis to determine if an error exists with respect to an elevator car position relative to a landing. The analysis can be performed on an output of the detector, such as image or video output.

If the landing positioning element and a first region thereof is detected by the detector, the system can determine that the elevator position is within requirements, and thus the flow process 500 can end. Alternatively, after detecting the elevator position at a first landing, the process can continue at a different landing (i.e., loop back to block 504), or can proceed to block 510 and generate a no error notification. Detection of the landing positioning element may prompt detection analysis to determine if the elevator car is properly leveled or positioned. For example, the detector can detect a region of the landing positioning element (e.g., a first region). When the first region of the landing positioning element is detected, such no error notification can be provided to inform a mechanic or technician that the elevator car leveling and positioning at the current landing is in compliance with desired operation and/or can be used for generating an inspection history. As such, if no error is detected, a landing position inspection system of the present disclosure can be configured to operate in various predetermined ways, without departing from the scope of the present disclosure.

If, at block 508, it is determined that a portion of the landing positioning element is detected within the inspection region, the flow process 500 continues to block 512. At block 512, the control unit (or other component) generates an error notification to indicate that there is an error with the positioning of the elevator car at the specific landing. In some embodiments, if an error message or error notification is generated, the control unit can limit the operation of the elevator system such that a specific elevator speed of travel cannot be exceeded until a "no error" is achieved (e.g., releveling operation, adjustment of elevator machine, etc.). Further, upon receiving an error notification or indication, a mechanic can perform a maintenance operation to fix the elevator system. After completing the maintenance operation, the system can run the flow process 500 again to determine if the maintenance operation corrected the error at the specific landing.

In some embodiments, as schematically shown, the flow process 500 can perform a loop with inspection performed at multiple landings in a single inspection operation (or every time the elevator car approaches and stops at a landing). For example, if a weekly maintenance inspection operation is performed, the elevator system can perform flow process 500 to inspect landing positions of the elevator car within an elevator shaft at one or more (including all) landing. When the system detects an error, such error can be noted (e.g., error notification at block 512), and the flow process 500 continues until all landings are inspected. At the end of all landings inspected, a single report can be generated that aggregates the error notifications and no error notifications of the flow process 500.

Those of skill in the art will appreciate that various example embodiments are shown and described herein, each having certain features in the particular embodiments, but the present disclosure is not thus limited. That is, features of the various embodiments can be exchanged, altered, or otherwise combined in different combinations without departing from the scope of the present disclosure.

For example, in another example, the detector can capture images that are transmitted to a display for manual inspection. In such embodiments, a mechanic can initiate an inspection operation, similar to flow process 500, but the flow process does not include blocks 508-512. Instead, captured images are transmitted to a display, either onsite or offsite, for inspection and analysis by a human (mechanic, analyst, etc.) and/or for automated and/or digital (computerized) inspection. When errors (e.g., elevator position outside of the first region 428 shown in FIG. 4) are detected, reports can be generated to indicate maintenance is required.

Advantageously, embodiments described herein provide automated inspection of elevator position at landings within an elevator shaft. The automation can be manually implemented and yet not require a technician to enter an elevator shaft, or can be fully automated as described herein.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator system comprising:

an elevator car within an elevator shaft;

a plurality of landing doors located at respective landings within the elevator shaft;

at least one landing positioning element installed within the elevator shaft and positioned relative to at least one landing door; and an inspection system comprising a detector located on the elevator car and arranged to detect the presence of the landing positioning element in an inspection region to determine if a position of the elevator car relative to the landing door is within a predetermined range, wherein the landing positioning element comprises at least one position detection subelement, wherein the at least one position detection subelement is a coded feature comprising a first region defining a range of position of proper alignment of the elevator car relative to the landing door and a second region that is outside of the first region, wherein, when the second region is detected within the inspection region, an error notification is generated by the inspection system.

2. The elevator system of claim 1, further comprising a control unit configured to:

analyze an output of the detector;

determine if there is an error in the elevator car position relative to the landing; and generate an error notification when an error in the elevator position is determined.

3. The elevator system of claim 2, wherein the control unit is located on the elevator car and in communication with the detector.

4. The elevator system of claim 1, wherein the detector captures images of the landing positioning element for inspection.

5. The elevator system of claim 1, wherein the landing positioning element includes at least one of a colored paint, a textured surface, or a reflective surface.

6. The elevator system of claim 1, wherein the detector is located on one of a top or bottom of the elevator car.

7. The elevator system of claim 1, wherein the detector comprises at least two cameras arranged to inspect multiple landing positioning element located at a specific landing.

8. A method for inspecting a landing position of an elevator car within an elevator system, the method comprising:

moving an elevator car to a landing within an elevator shaft;

observing an inspection region using a detector located on the elevator car, the inspection region being a region including a landing positioning element positioned relative to a landing door of the landing, wherein the landing positioning element comprises at least one position detection subelement, wherein the at least one position detection subelement is a coded feature comprising a first region defining a range of position of proper alignment of the elevator car relative to the landing door and a second region that is outside of the first region, wherein, when the second region is detected within the inspection region, and error notification is generated by the inspection system;

determining if an error exists with the position of the elevator car relative to the landing based on the landing positioning element within the inspection region; and generating an error notification when an error in the elevator position is determined, when the second region is detected within the inspection region.

9. The method of claim 8, further comprising:

analyzing an output of the detector with a control unit to determine if the error exits.

10. The method of claim 8, wherein the method is performed automatically based on at least one of (i) a maintenance schedule, (ii) a predetermined interval, (iii) every time the elevator stops at a landing, (iv) a customer complaint, (v) a request made at an onsite location, (vi) a request made at an offsite location, or (vii) a scheduled maintenance visit.

11. The method of claim 8, further comprising capturing images of the landing positioning element for inspection.

12. The method of claim 8, wherein the landing positioning element includes at least one of a colored paint, a textured surface, or a reflective surface.

13. The method of claim 8, wherein the detector comprises at least two cameras arranged to inspect multiple landing positioning element located at a specific landing.

14. The method of claim 8, further comprising:

moving the elevator car to a second landing within the elevator shaft;

observing an inspection region of the second landing using the detector, the inspection region being a region including a landing positioning element at the second landing;

determining if an error exists with a position of the elevator car relative to the second landing based on the landing positioning element detected within the inspection region at the second landing; and generating an error notification when an error in the elevator position is determined.

* * * * *